US007398033B2

(12) United States Patent
Karagiannis et al.

(10) Patent No.: US 7,398,033 B2
(45) **Date of Patent: *Jul. 8, 2008**

(54) SYSTEMS AND METHODS FOR REMANUFACTURING IMAGING COMPONENTS

(75) Inventors: Antonios L. Karagiannis, Raleigh, NC (US); Mark D. Reeves, Cary, NC (US); Lynton R. Burchette, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/507,407

(22) Filed: Aug. 21, 2006

(65) Prior Publication Data

US 2006/0285876 A1 Dec. 21, 2006

Related U.S. Application Data

(63) Continuation of application No. 11/225,740, filed on Sep. 13, 2005, now Pat. No. 7,099,606, which is a continuation of application No. 10/780,988, filed on Feb. 18, 2004, now Pat. No. 7,099,599, which is a continuation-in-part of application No. 10/641,617, filed on Aug. 15, 2003, now Pat. No. 6,882,810.

(51) Int. Cl.
*G03G 15/00* (2006.01)

(52) U.S. Cl. ..... 399/109

(58) Field of Classification Search ..... 399/109, 399/27

See application file for complete search history.

(56) References Cited

U.S. PATENT DOCUMENTS 5,995,774 A * 11/1999 Applegate et al. ..... 399/27
6,227,638 B1 * 5/2001 Childers et al.
6,318,850 B1 * 11/2001 Childers et al.
7,099,606 B2 * 8/2006 Karagiannis et al. ..... 399/109

* cited by examiner

*Primary Examiner*—Susan S. Lee

(57) ABSTRACT

A method of remanufacturing a replaceable consumable unit includes providing the replaceable consumable unit including a first electronic circuit, with the first electronic circuit being at least partially inoperable; providing a second electronic circuit; communicatively connecting the second electronic circuit to the first electronic circuit; and intercepting, by the second electronic circuit, signals sent by an imaging system to the first electronic circuit.

26 Claims, 10 Drawing Sheets

SYSTEMS AND METHODS FOR REMANUFACTURING IMAGING COMPONENTS

The present application is a continuation of U.S. patent application Ser. No. 11/225,740 filed Sep. 13, 2005, which in turn is a continuation of Ser. No. 10/780,988 filed on Feb. 18, 2004, which is in turn is a continuation-in-part (CIP) of U.S. patent application Ser. No. 10/641,617, now U.S. Pat. No. 6,882,810, filed on Aug. 15, 2003, both of which are hereby incorporated by reference herein in their entirety.

BACKGROUND

Different imaging devices utilize various types of replaceable consumable units. Each type of xerographic or electrophotographic device may have unique requirements such as specific compatible toner, size requirements necessary to fit into a specific printer, power consumption, interface with the printer and so forth. A typical replaceable consumable unit such as a toner cartridge contains many different components such as toner, the OPC drum, developer roller and so forth. In addition, these replaceable consumable units are not limited to just toner cartridges but may also include intermediary OPC drum assemblies. The replaceable consumable units will also vary between monochrome and color based devices. As technology continues to improve, there is no end in sight to the variations of replaceable consumable devices that will be necessary to interoperate with the new and improved xerographic devices.

Along with the moveable parts, printer manufacturers have also moved data down to the replaceable consumable unit. Initially in some toner cartridges, the Original Equipment Manufacturers (OEM's) devised a way of detecting cartridge specific information from the cartridge itself. This was done via a mechanical process. With electronic circuits becoming smaller, more efficient and able to perform various tasks, printers are increasingly moving additional data to the replaceable consumable units. For example, information such as operating voltage, cartridge serial number, manufacturing history, printer history, toner consumption, and remaining toner may be stored locally on the cartridge. This allows the information associated with a specific cartridge to move with the cartridge should it be transported from one printer to another. It also allows the manufacturer to track the cartridge during its lifetime.

One method of obtaining information from the replaceable consumable unit and storing it on the cartridge is outlined in U.S. Pat. No. 5,995,774 issued to Applegate, et al. The patent describes a method and apparatus for storing data corresponding to the amount of toner remaining in an electronic circuit located on a xerographic toner cartridge. This circuit is in electrical communication with the printer via electrical contacts. The printer determines the amount of toner remaining as a value and this value is converted into "bucket levels" stored inside the memory of the electronic circuit. The initial bucket level corresponding to the amount of toner remaining in a new cartridge is full, and over the life of the cartridge, this value would be decremented down accordingly. The electronic circuit is designed such that the bucket levels may only be decremented and never incremented. Thus when the replaceable consumable unit reaches an empty state, the printer would recognize that there was no toner remaining and would designate the bucket levels to be empty. Once the bucket level had been declared empty, the cartridge was spent and subsequently it needed to be replaced.

Once a used replaceable consumable unit such as a toner cartridge has depleted its supply of toner it may be recycled. An industry known as the remanufacturing industry has arisen to take advantage of this fact. Remanufacturers take the used replaceable consumable units, clean them, repair damaged components, replace worn out components, add new toner, and reintroduce these refurbished units into the marketplace. Some of the many components that the remanufacturers replace may include the PCR, OPC drum, magnetic roller, wiper blades, agitators, seals, encoder wheels, and electronic control circuitry just to name a few.

In order to protect its profitability, the OEM's designed the replaceable consumable unit to be a single use product. Once the product had reached the end of its life, the OEM anticipated that the consumer would discard the used part and replace it with a new replaceable consumable unit. Additionally, the OEM has ensured that the replaceable consumable units may not simply be refilled with toner, refurbished and placed back into service, by installing protection measures on the replaceable consumable unit. For example, several OEM's have installed a one-time writable electronic circuit onto the replaceable consumable unit itself. The imaging device has the ability to interface with this electronic circuitry and once this circuit has been disabled, the replaceable consumable unit ceases to function.

One advantage of the present invention is that it provides a way to repair these electronic circuits in the various replaceable consumable units once they have been disabled during their normal course of life. The invention allows a second electronic circuit to communicate with the printer in conjunction with the existing nonfunctional electronic circuit. By taking advantage of the existing circuit's ability to talk to the printer, the secondary circuit can perform the functions that the initial circuit has been disabled from performing. The non-functioning electronic circuit will be connected to a second electronic circuit so that the second electronic circuit will be able to intercept electrical signals intended for the non-functioning circuit. By monitoring the communications coming from the printer, the second electronic circuit will intercept, process and resend the data to the first circuit. The first circuit will respond accordingly and it will reply with the proper sequence of data. The interplay between these circuits is described in greater detail in a later section.

In the preferred embodiment, a microprocessor will be used. It will be able to determine when the specific locations corresponding to the toner level are being accessed and will subsequently use its own memory locations to store this information. Once the cartridge using the second electronic circuit has depleted all of the usable toner the printer will once more write the appropriate value in the correct location in memory and the printer will disable the ability to change this location. The cartridge is then sent back to be recycled.

Another aspect of the present invention is that it provides the flexibility for various methods of attaching the second circuit to the non-functioning electronic circuit. The location of the contacts of the second electronic circuit is dictated by the location of the electrical contacts of the printer. However, the actual location of the second electronic circuit itself may be anywhere on the replaceable consumable unit, as long as there is space for mounting of the circuit as well as electrical connectivity to the printer contacts.

Another aspect of the present invention is that it encompasses the use of a replacement electronic circuit. This replacement circuit will provide additional functionality that the original OEM circuit did not employ. For instance, the replacement circuit will have the ability to make the replaceable consumable unit more reliable by providing a back-up or alternative path for the communications to the printer. By designing the circuit with redundant paths, which can be changed on the fly, the circuit becomes more robust. When this occurs, the present invention will notify the user that an error condition was detected and that the communications path has been switched. These types of errors would be undetectable in the existing circuitry of the replaceable consumable device due to hardware limitations. In addition, the replacement circuit will make the replaceable consumable unit recycle friendly by having the ability to be reprogrammed by using a special reprogramming dongle. When the replacement circuitry has been disabled by the imaging device, a remanufacturing service technician will have the ability to reprogram the device without removing the replacement circuit from the replaceable consumable unit. This gives the remanufacturer increased flexibility when refurbishing the cartridge.

Another aspect of the present invention is the ability of the invention to modify the voltage potential being applied to some of the developer components of the replaceable consumable. Over time, as the imaging device creates thousands of printed copies of images, the voltage potential being applied to the developer components will vary. The goal is that once a certain amount of toner has been used, the replaceable consumable unit will alter the voltage potential such that the printer may use less toner, thus conserving the remaining toner.

Another type of replaceable consumable unit utilizes a wireless configuration to communicate between the circuitry on the replaceable consumable unit and the printer. In this type of application, the replaceable consumable unit is written to and read from in a comparable fashion as discussed previously. As well, the same type of information may be stored on the cartridge for the printer to monitor and update. Similarly, in this application, once the toner supply is exhausted, the printer writes into a specific location on the circuit and disables the circuitry.

Without the present invention, hundreds of thousands of used replaceable consumable units are being thrown away instead of being recycled simply due to the non-functional electronic circuit. The availability of new OEM electronic circuits is completely at the discretion of the OEM's. Given that the OEM's make a healthy profit from the sale of new replaceable consumable units, and receive no monetary benefit from a remanufactured replaceable consumable unit, it has been very difficult for the remanufacturing industry to obtain new electronic circuits. The use of these one-time writable circuits, which employ an exclusive communications protocol was an attempt by some of the OEM's to restrict the remanufacturing of its cartridges.

SUMMARY

The present invention is directed at a method for repairing an electronic circuit for a remanufactured replaceable consumable unit comprising the steps of providing a remanufactured replaceable consumable unit having an initially inoperable electronic circuit attached to it, the replaceable consumable unit being housed in a printing system. A secondary electronic circuit will be introduced such that the secondary electronic circuit will be in electrical communication with the initially inoperable electronic circuit. The second electronic circuit will intercept electronic signals sent by the printing system to the replaceable consumable unit, and the secondary electronic circuit will interoperate with the printing system so that the printing system will determine that the replaceable consumable unit will function with both the initially inoperable electronic circuit and the secondary electronic circuit working in conjunction to one another.

In one aspect, an electronic module for use in a printer consumable unit comprises a first input and output (I/O) port adapted connected to an external contact, and a second I/O port connected to the external contact. Circuitry controls the electronic module and responds to read memory commands and write memory commands received through the external contact on the I/O ports. A memory stores data. A third port is connected to the external contact and adapted to source current. The circuitry is initially configured to send and receive data through the first I/O port. The circuitry tests the functionality of the first I/O port by directing the third port to source current and drive the external contact to a predetermined voltage, and read a voltage received by the first I/O port in response to sourced current. If the circuitry determines the first I/O port is not functioning correctly based on the read voltage, the circuitry will send and receive data through the second I/O port.

A more complete understanding of the present invention, as well as further features and advantages of the invention, will be apparent from the following detailed description and the accompanying drawings.

DETAILED DESCRIPTION

Figure 2:
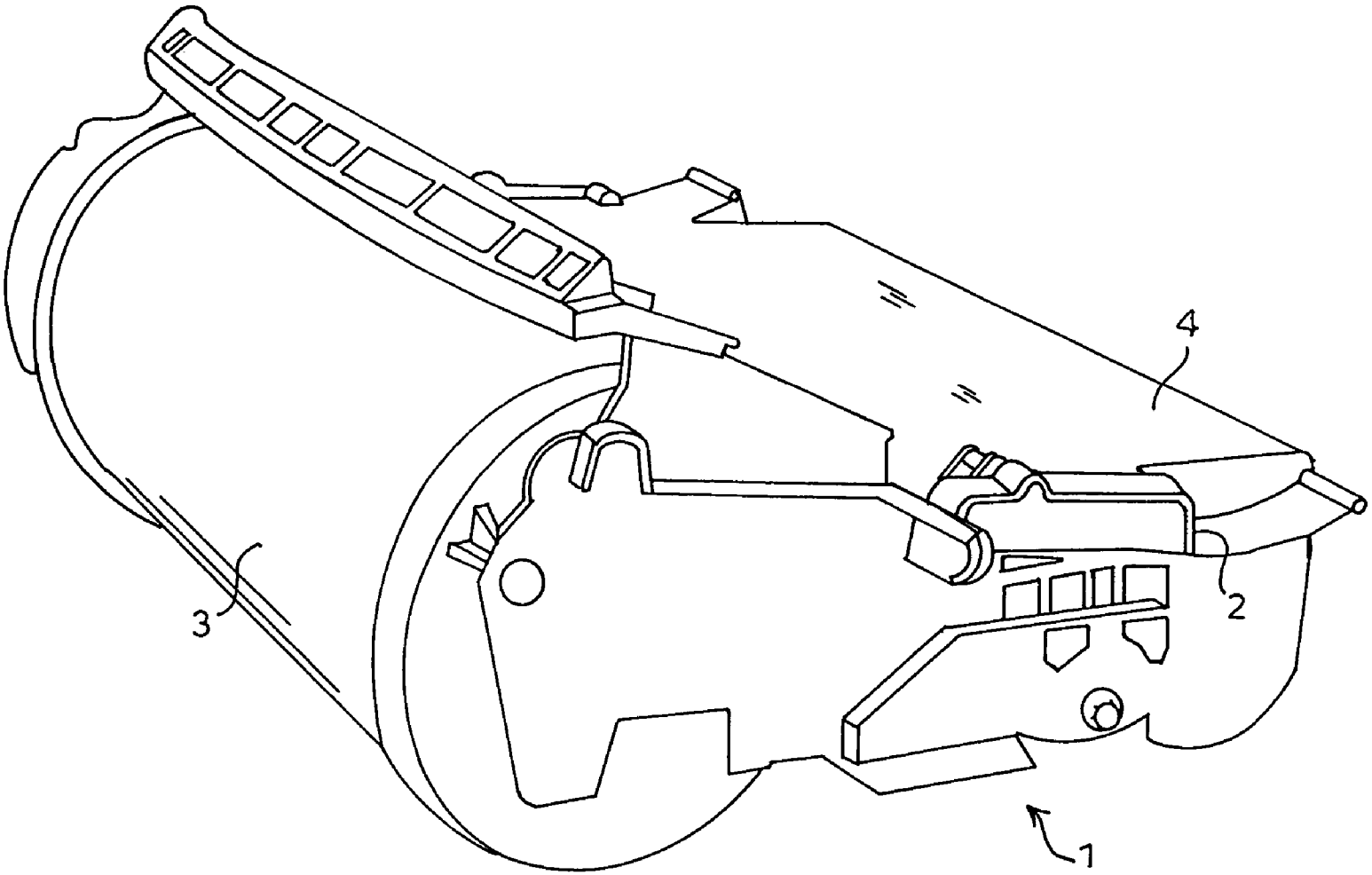
PRIOR ART FIG. 2
FIG. 2. is a perspective view of a prior art printer cartridge.
Figure 11:
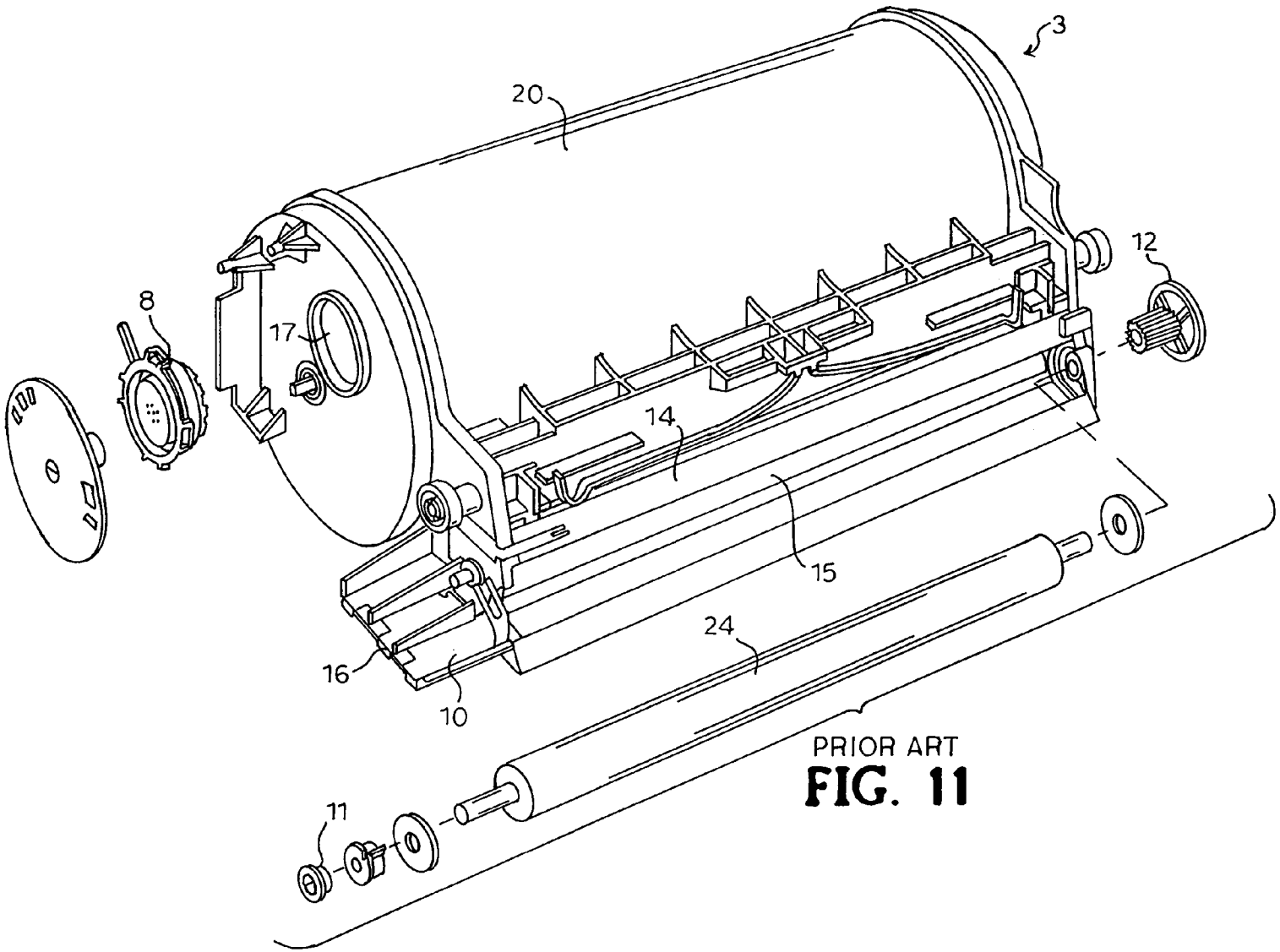
PRIOR ART FIG. 11
FIG. 11 is a perspective view of a toner hopper assembly.

A typical xerographic replaceable consumable unit such as a toner cartridge comprises several subassemblies and subcomponents. An example of a prior art toner cartridge is illustrated in FIG. 2. A more detailed illustration of the toner hopper portion of this cartridge is shown in FIG. 11. The remanufacturer will take the spent or used cartridge, disassemble it down to a serviceable level and then replace the worn out or broken items. After servicing the cartridge the remanufacturer reassembles the pieces back into a fully functional unit and introduces this refurbished product into the marketplace.

The newer replaceable consumable units have an electronic circuit, which is utilized for various functions. Some of the prior art describes the use of this circuitry to store information that is unique to the specific toner cartridge. Information that may be stored in this electronic circuit includes data such as the serial number of the cartridge, the model type, the yield, the amount of toner remaining and so forth. The printer periodically accesses the information stored in the electronic circuit during the life cycle of the replaceable consumable unit. Whenever the cover of a printer is opened or if the power is turned back on, the printer will query the printer cartridge to obtain its current status. This query is due to the fact that the printer does not know if it is the same cartridge that was installed prior to the reinitializing event. The printer needs to know the cartridge characteristics of the replaceable consumable since it must set certain parameters based on this information.

This electronic circuit has also been used to thwart any recycling of these replaceable consumable units by third parties not affiliated with the OEM. The OEM's have employed various types of methods to make any refurbishment of the cartridges extremely difficult if not impossible. To begin with, the circuit is designed to become disabled by the printer once the toner level has reached an empty state. Another level of difficulty is that the two components may employ a unique communication scheme. Additionally, the printer might require a validation of the communication. Another level of difficulty that the printer could employ could involve an encryption of the communications in addition to the validation. The list of different ways to encode this information and lock out a third party is endless.

A second electronic circuit can be introduced to repair the nonfunctional circuit during the refurbishment process. This second electronic circuit would allow the first circuit to still operate, but all communications with the printer would be intercepted. The second electronic circuit has the capability to monitor the communications going back and forth between the printer and the first electronic circuit. By monitoring the communications coming from the printer, the second electronic circuit will intercept, process and resend the data to the first circuit. The first circuit responds accordingly and this is retransmitted to the printer. The microprocessor will also be able to determine when the specific locations corresponding to the toner level are being accessed and will subsequently use its own memory locations to store this information. The processor in the preferred embodiment would provide a new memory location that would store the toner bucket level. Once the cartridge using the second electronic circuit has depleted all of the usable toner it will once more write the appropriate value in the correct location in the processor and the processor will disable the ability to change this location. The cartridge will then be sent back to be recycled.

In order for the electronic circuit mounted on a replaceable consumable unit to function properly it must effectively communicate with the printer. As is common in any bi-directional communication architecture, both communicating devices must be able to send and receive information according to agreed upon protocol and timing criteria. Each printer or family of printers may employ unique protocol schemes. In one embodiment of the present invention the electronic circuit of the replaceable consumable unit will communicate with the printer via a one-wire bus architecture protocol. This is the protocol used by the Lexmark T520/T620 printer family. This protocol is based on a one wire standard developed by Dallas Semiconductor. The Lexmark T520/T620 printers use a Dallas DS2432 chip to facilitate the communications function on the replaceable consumable unit. An embodiment of the present invention must be able to emulate this protocol.

The Dallas DS2432 chip also employs a verification technique called SHA-1 or Secure Hash Algorithm-1. This hash algorithm was first created for the Federal Government to be used in conjunction with an encryption scheme. The difference between an encryption algorithm and a hash algorithm is that the hash is unidirectional or one way only. Once information is encoded into an encryption scheme, the data may be extracted once the key is used to unlock the information. This is in contrast to the hash computation because the data is not recoverable once it is used in computing the hash. The hash algorithm is used as a complex way of verifying data integrity similar to the basic cyclic redundancy check that exists in many of the early data communication designs. The SHA-1 algorithm has become an accepted standard for data transmission verification. It uses a complex scheme of mathematical equations and data manipulations to "process" a 64-byte input and determine a 20-byte response sequence. What makes this process unique, when applied in conjunction to this Dallas part, is that of the 64-byte input, 8-bytes are pseudo random data that is stored in a "secret" location which is unreadable. These 8-bytes are downloaded into the part when it is initially stored with data from the factory. Anyone who is skilled in the art might be able to decipher the formula for determining this random data being loaded into this secret location by crunching all of the different possible combinations of the 8-bytes. The total number of combinations would be roughly $1.845\times10^{19}$. As one could imagine the number crunching might possibly take years if all the possible combinations were tested.

When refurbishing replaceable consumable units, remanufacturers have been limited in what they are able to do to repair these circuits once they have become disabled. If a completely new replacement circuit were to be developed, it would have to be able to implement this random number. Without the actual knowledge of how it is generated, a remanufacturer would have to generate random numbers until one could be found that would be compatible with a certain set of circuit data. It is analogous to searching for the proverbial needle in a haystack. Absent the ability to decipher the hash, a replacement electronic circuitry is essentially worthless. As pointed out previously, these techniques may be proprietary or extremely difficult to understand. Thus the printer and electronic circuit must be able to communicate and "shake hands" in order for a toner cartridge with such circuitry to be functional within the printer. One aspect of the present invention takes advantage of the nonfunctional electronic circuits capability to speak the unique language as well as employ the encryption protocol. Additionally, once the authentication sequence has been deciphered, a fully functional replacement device employing this technique may be offered utilizing this scheme.

Figure 1:
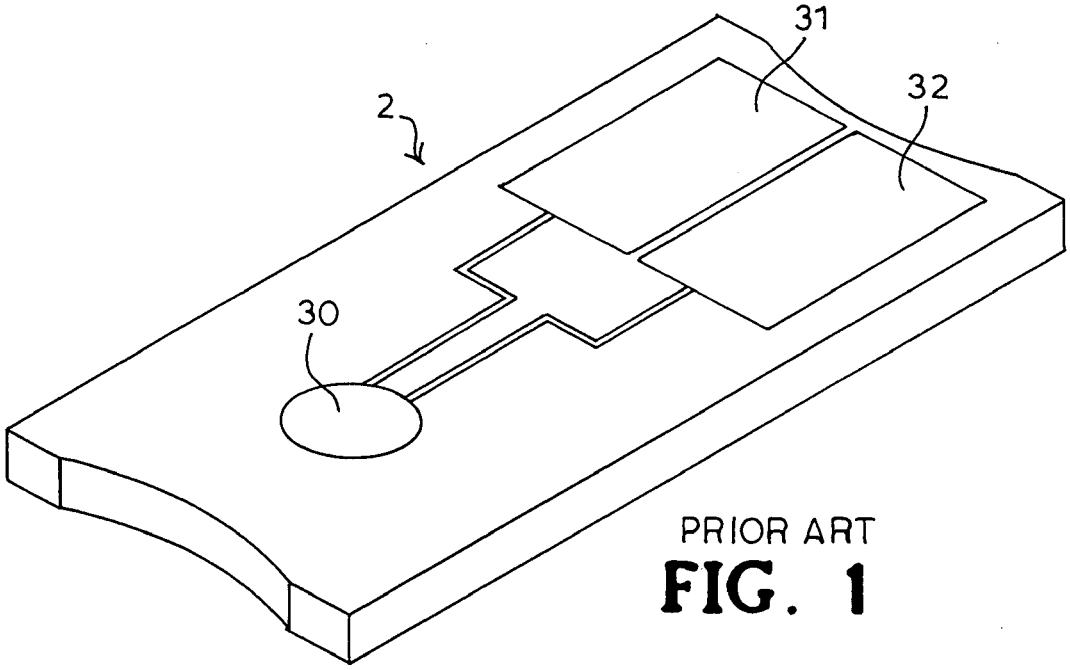
PRIOR ART FIG. 1
FIG. 1 is a perspective view of the prior art of a first electronic circuit board.

In order to interface with the electronic circuit some printers use electrical contacts. When the toner cartridge is inserted these printer contacts make an electrical connection with the contacts of the electronic circuit. FIG. 1 is a drawing of an example of a first electronic circuit 2 employing an electrical contact type interface. All of the discrete logic 30 for the electronic circuit is located on the top surface of the first electronic circuit 2. The first electronic circuit 2 contains two printer interfacing electrical contacts, a first electronic circuit data contact 32 and a first electronic circuit ground contact 31. Because the printer's electrical contacts (not shown) are fixed, the contacts of the first circuit board as well as contacts for any replacement circuit must be within their reach and maintain the proper orientation. These printer contacts may be metal springs, clips, or other types of conductive material so that when the cartridge is inserted into the printer the weight of the cartridge, as well as the closing of the printer cover, will exert enough pressure to ensure sufficient and reliable electrical connection.

Figure 3:
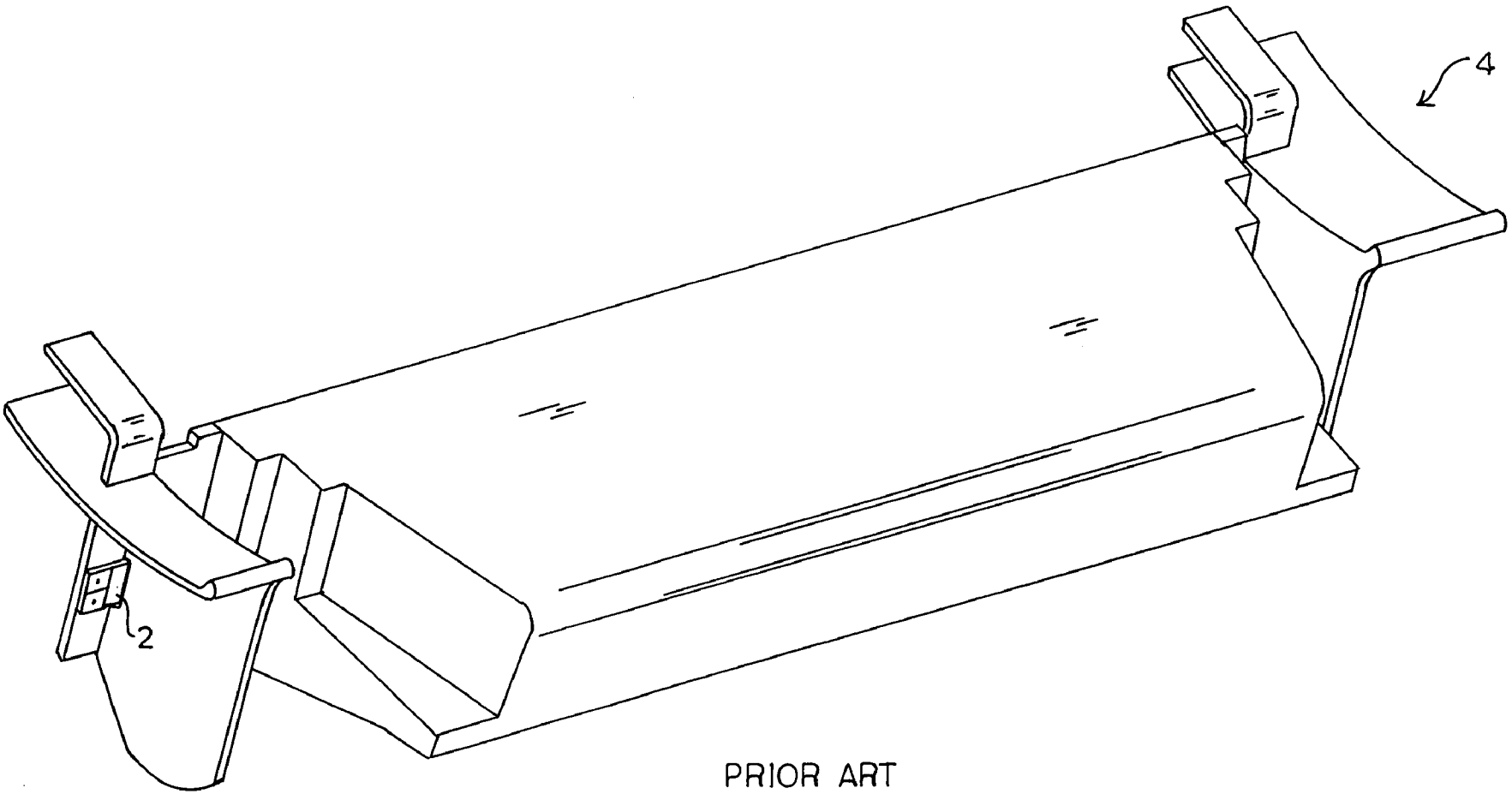
PRIOR ART FIG. 3
FIG. 3 is a perspective view of a prior art waste bin assembly.

Examining the Lexmark T520/T620 toner cartridge can show an excellent application of the previously discussed principles. FIG. 2 shows the printer cartridge 1. When fully assembled, the cartridge 1 has a toner hopper assembly 3 and a waste bin assembly 4. On the side of the waste bin assembly 4, the electronic circuit 2 is located. FIG. 3 shows in greater detail the location of the first electronic circuit 2 in a side area of the replaceable consumable unit. Here the two printer interfacing contacts are clearly shown.

Other printers such as the Hewlett Packard 4100 incorporate a wireless communication method to interface to the circuit on the replaceable consumable unit. The same concepts applied in the Lexmark T520/620 printer have been adapted for use in the wireless applications. In making the recycling process for the replaceable consumable unit more difficult, the HP4100 disables the circuit on the replaceable consumable unit once it has determined that no usable toner remains in the cartridge. To disable the cartridge the printer will write a "disable" value to a specific location in the memory of the circuit. Once written, this memory address may not be overwritten. Simple replacement of this circuit may not be feasible if the communication between the printer and the cartridge employs a unique language or encryption. Therefore, the present invention is applicable to this type of printer since the secondary circuit will take advantage of the disabled circuit's ability to speak the printer language as well as provide a new memory location for this disabling value.

In the preferred embodiment of the present invention as applied to the Lexmark T520/620 contact replaceable consumable unit, a 16-bit microcontroller such as the Texas Instruments MSP430F1121A is used. This processor provides a way to communicate between the nonfunctional circuit on the replaceable consumable unit and the printer. This part is especially desirable due to its ability to function at low voltages, its low power dissipation and its low cost. In this application the microcontroller has an operating voltage that may vary between 3.0 V DC and 4.2 V DC. An additional design restriction for this second electronic circuit is that it will only be supplied a limited amount of current.

The second electronic circuit together with the first circuit may not exceed the power limitations of the printer supply. The power for these circuits will be derived from the one-wire contacts. Under normal operating conditions this particular microcontroller will require approximately 160 μA to function. When evaluating a replacement circuit alternative, caution must be taken not to overdrive the printer data circuit. Not only must the communications be conducted over these contacts but the power to run these devices must also be supplied from them as well.

Figure 4:
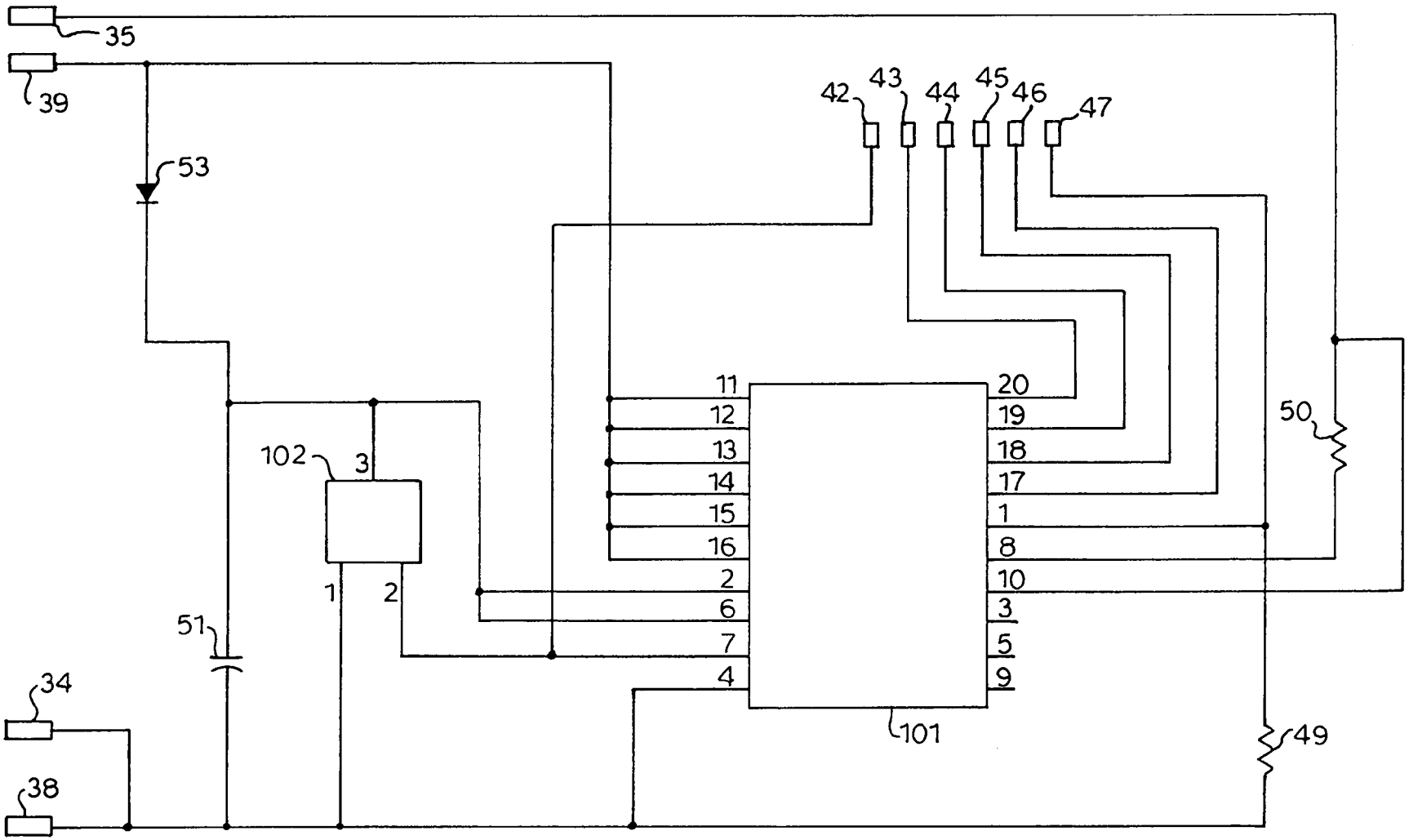
FIG. 4. is a schematic drawing of a second electronic circuit.

FIG. 4 is a schematic drawing of the preferred embodiment of a second electronic circuit. The microprocessor 101 illustrated in this schematic is a 20 pin surface mount device. The interconnect ground contact 34 and the interconnect data contact 35 are referred to in FIGS. 5A and 5B and are electronically connected to the inoperable circuit's printer interfacing contacts, the first electronic circuit data contact 32 and the first electronic circuit ground contact 31. The second electronic circuit printer interfacing ground contact 38 and second electronic circuit printer interfacing data contact 39 are the contacts that will engage the printer's interfacing contacts. Contacts 42, 43, 44, 45, 46, 46, and 47 are used to initially program and test the processor. Resistor 49 is required for the present design in order to keep the processor out of "test" mode and resistor 50 is added for additional maintenance functionality. Specifically, this maintenance functionality allows the processor to drive the data line to a logic high and monitor the line to make sure that electrically the port is acting appropriately.

Due to size constraints in the preferred embodiment of the secondary circuit, a battery is not feasible to power the processor. Instead a capacitor 51 is used to store enough voltage potential. In the preferred embodiment, a 22 μF capacitor 51 will provide enough current to keep the processor operational while the communications line is driven low due to communications taking place. In addition, a special reset circuit 102 will be used to reset the processor. The purpose of this circuit is to allow enough time for the power rail to become stable before allowing the processor to start operating. This part will hold the reset line of the processor low for an additional 200 mS after a 2.25 VDC threshold has been reached. Delaying the processor from starting until the power rail has become stabilized, ensures that the processor has enough power to run. During insertion of the replaceable consumable unit into the printer, the power applied to the data pin may fluctuate for a brief period of time. This circuit simply makes sure that the power rail has had enough time to stabilize before starting the microprocessor. In addition, a Shottky diode 53 is placed in the design to prevent any reverse current from flowing from the capacitor to the printer during times when the printer is driving the data line low.

Another advantage of the preferred embodiment is that no external clock or oscillator is required. All of the communications between the printer and replaceable consumable unit are of an asynchronous nature. The replacement circuit must be able to see when the printer is trying to communicate with it and respond within a certain time window. The MSP430F1121A has an internal clock that will allow it to function independently without an external source. This part also provides a "sleep" mode that further conserves power. During sleep mode the microcontroller uses only 0.7 μA. Additionally, it will only take 6 μs for the microcontroller to return to a ready state.

Figure 5A:
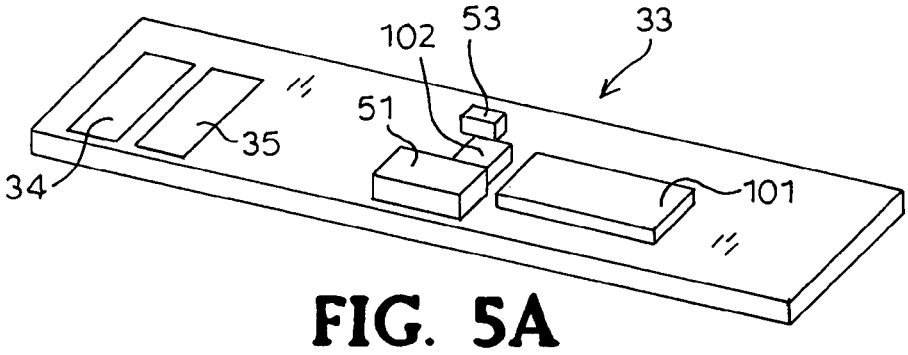
FIG. 5A is a top perspective view of one embodiment of the present invention.
Figure 5B:
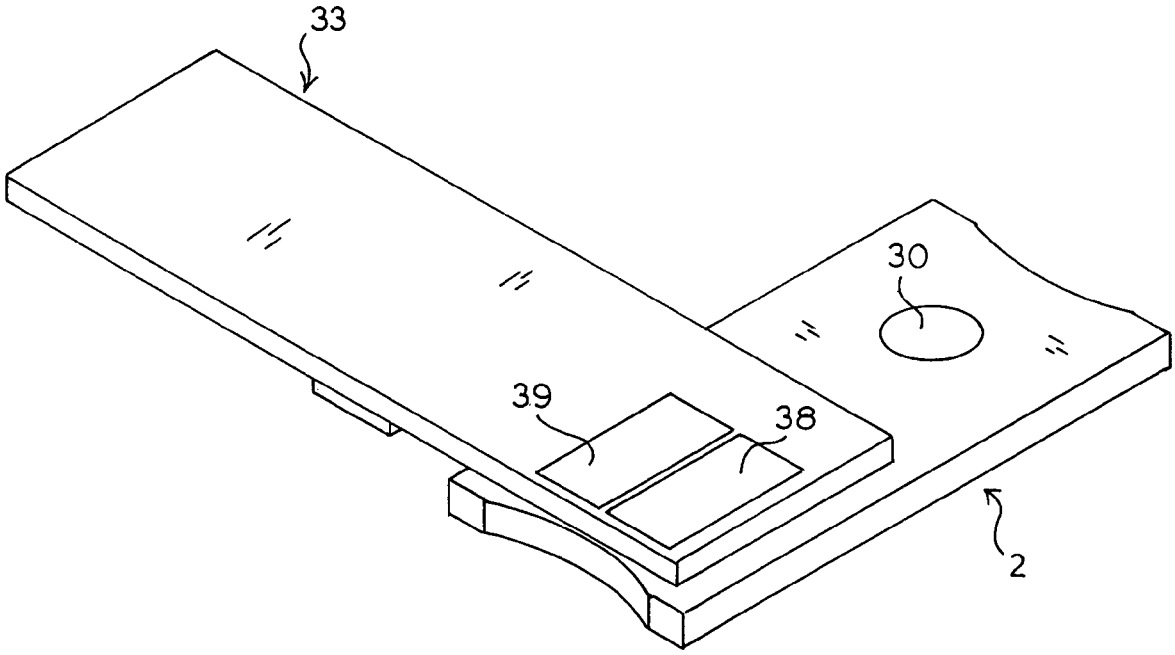
FIG. 5B is a bottom perspective view of one embodiment of the present invention with a first electronic circuit attached.

FIGS. 5A and 5B illustrate one embodiment of the present invention. FIG. 5A shows a top perspective view of a second electronic circuit 33. The second electronic circuit 33 has two interconnect contacts, a interconnect ground contact 34 and an interconnect data contact 35. A first electronic circuit 2 is then connected to the second electronic circuit 33 by soldering the interconnect ground contact 34 and the interconnect data contact 35 to the two printer interfacing electrical contacts, the first electronic circuit ground contact 31 and the first electronic circuit data contact 32 of the first electronic circuit 2.

FIG. 5B shows a bottom perspective view of the same embodiment containing a first electronic circuit 2 attached to a second electronic circuit 33. From this view two printer interfacing electrical contacts, first electronic circuit ground contact 31 and the first electronic circuit data contact 32 are shown. Once the first electronic circuit is attached, the second electronic circuit 33 will need to communicate to the printer via the second printer interfacing electrical contacts, a second electronic circuit printer interfacing ground contact 38 and a second electronic circuit printer interfacing data contact 39. When this embodiment is mounted on the toner cartridge the two printer interfacing electrical contacts of the second electronic circuit will be facing away from the body of the waste bin 4. The fully assembled product, consisting of the first electronic circuit 2 mounted on the present invention, must be able to fit within the space of the original first electronic circuit 2. Instead of soldering the two parts together, the interconnect ground contact 34 and the interconnect data contact 35 may be slightly raised or convex so that the first electronic circuit might be held in place by glue or another adhesive.

Figure 6:
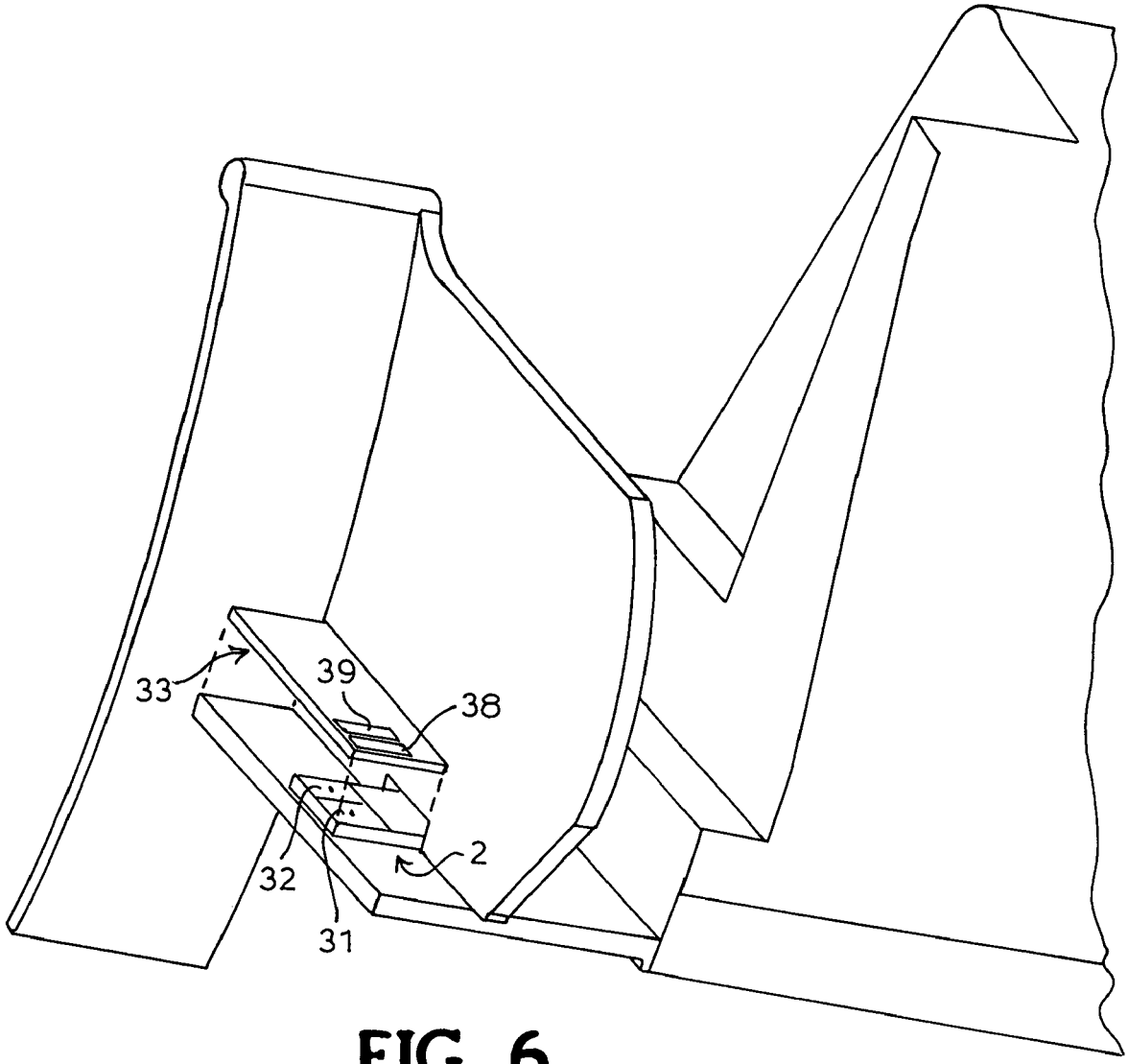
FIG. 6 is an exploded view of a second electronic circuit mounted on a first electronic circuit.

FIG. 6 shows an exploded perspective view of an embodiment of the present invention as previously illustrated in FIGS. 5A and 5B. The second electronic circuit 33 is installed on top of the first electronic circuit 2. In this manner the first electronic circuit 2 does not need to be removed from the replaceable consumable unit in order to install the second electronic circuit 33 on the replaceable consumable unit. The second electronic circuit 33 can then be soldered on to the first electronic circuit 2 while the first electronic circuit 2 is still attached to the replaceable consumable unit.

Figure 7:
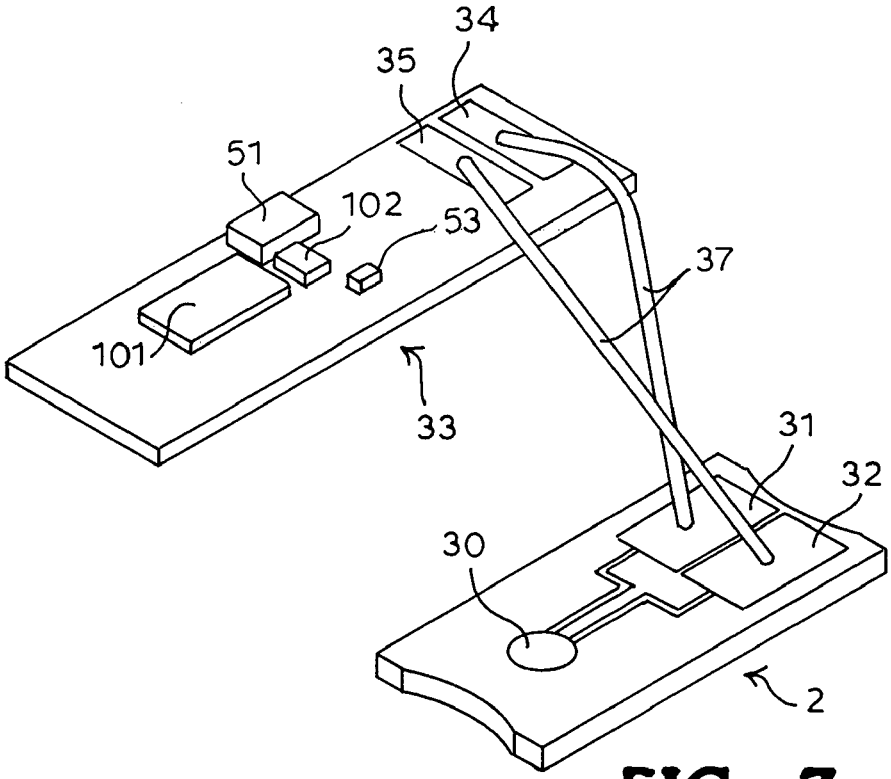
FIG. 7 is a top perspective view of a second embodiment of the present invention.

FIG. 7 is a second embodiment of the present invention. Here the two printer interfacing electrical contacts of the first electronic circuit 2 are connected to the interconnect ground contact 34 and the interconnect data contact 35 via wires 37. An advantage of this embodiment is that it allows for the invention to be used on cartridges that may not allow much room to position the second electronic circuit. There may be a suitable mounting location for the second electronic circuit away from where the original first electronic circuit was located, as long as connectivity to the printer contact pins can be taken into account.

This microcontroller is initially programmed using a unique programmer. In the preferred embodiment the circuit board that the processor will be mounted on will have separate contacts that will allow programming. This is essential because this part will require approximately 6.5 V DC in order to burn the appropriate memory locations. The microprocessor may be programmed either serially via the data line of the circuit or via a parallel bus. Programming the device via the parallel bus may be accomplished more efficiently by reading and writing in bytes as opposed to bits. Conversely, the handshaking that occurs in the serial procedure will slow down the programming process. However, by having a serial process available, the design becomes more adaptable due to the fact that during the refurbishment process the microprocessor may be reprogrammed by the use of a special dongle. The microcontroller may also be reprogrammed while still mounted on the replaceable consumable unit. This saves time and effort by not having to remove the chip, reprogram it and then reattach it.

Another major advantage of using a microcontroller or a microprocessor in this particular application is that the design may be modified at a later date simply by reprogramming the device. However, there is no restriction or requirement that this particular part or programmable device be used for this application. If flexibility or adaptability is an essential element in the design of the second circuit, then discrete logic may not be the best alternative. By using a microcontroller that contains intelligence, the second circuit may also be utilized to perform additional functions that the original circuit is incapable of doing. In this embodiment the microcontroller will monitor the communication that occurs between the printer and the replaceable consumable unit. It will be able to see what information is flowing to the replaceable consumable unit and take the appropriate action.

Figure 8:
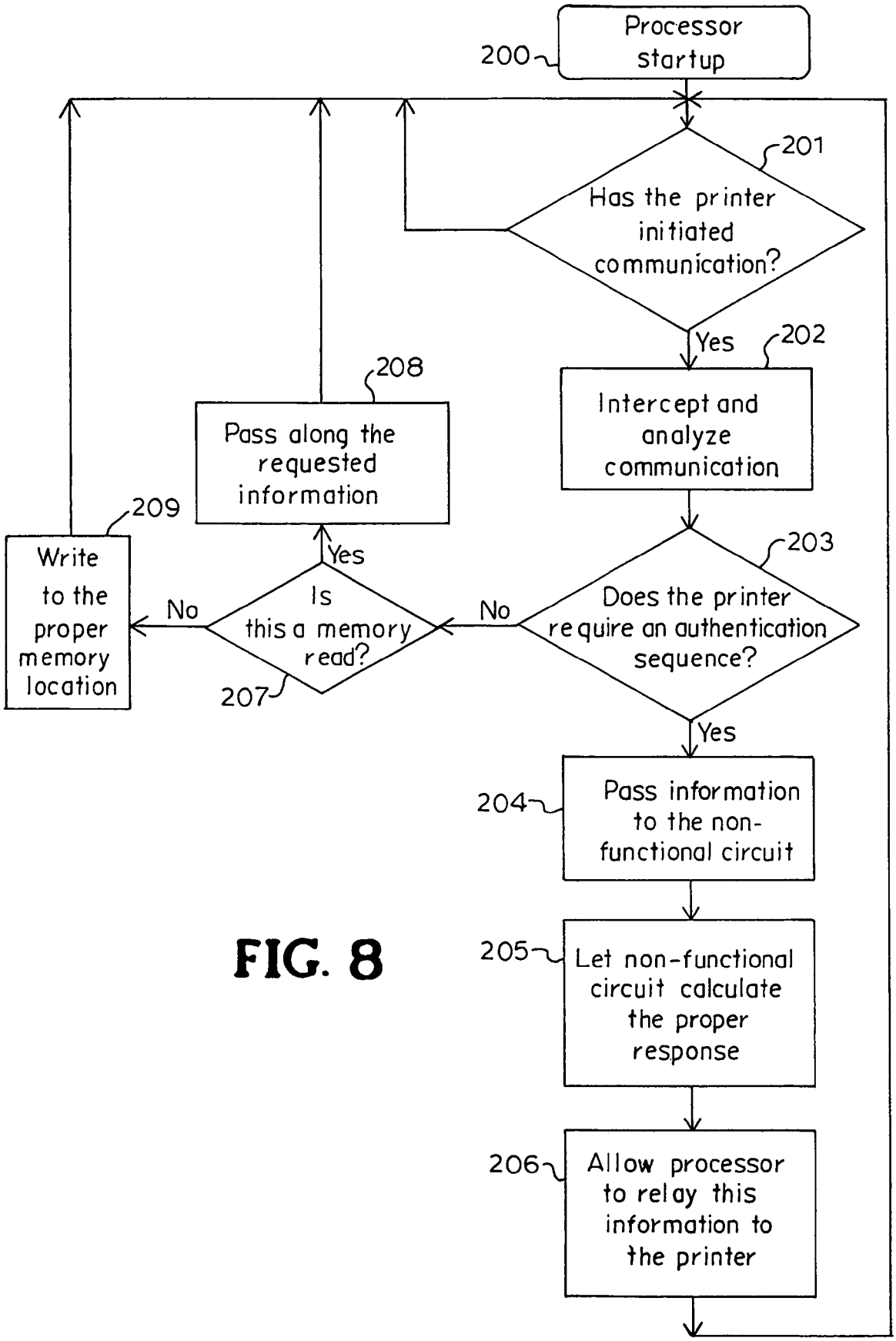
FIG. 8 is a flow chart of the second replacement circuit logic.

FIG. 8 illustrates the program flow that the preferred embodiment of the replacement circuit will execute. Upon initial start up, the processor will perform its own internal and external diagnostics 200. Once the printer has completed the diagnostic procedure, it will determine if the printer has initiated a communication 201. In this particular design architecture the circuit on the replaceable consumable device will never initiate communications with the printer. The printer will always be the master. Therefore, the processor must monitor the data line to see if the printer is trying to gain the circuit's attention. Once the printer has tried to talk to the replaceable consumable unit, the processor will intercept and analyze the communication 202. If the cover has been opened and shut or if the printer has gone through a power cycle the printer will initiate an authentication sequence 203. This will require that the proper hash will be returned to the printer before any further exchange of information will be allowed. In order to get the correct response, the information sent by the printer is passed to the nonfunctional circuit 204. The processor will become the master and the nonfunctional circuit will become the new slave. The nonfunctional circuit will then calculate the appropriate hash value and send it to the processor 205. The processor then will receive this information and immediately send it back out to the printer 206. The processor may additionally store this value should the printer reinitiate the startup sequence again at a later time.

The printer will receive the appropriate hash and determine that it will allow information to pass down to the replaceable consumable unit. The next phase will be to read additional information stored on the device such as the current bucket level. For this to occur, the printer starts the communication tango 201. This time however, no authentication sequence is necessary because the printer is happy with the identity of the cartridge. Therefore, the function will be either a read or a write to locations in memory. The processor will determine if it is a read request 207, access the information 208 and pass it along to the printer. If it is not a read request, it will be a write request and as a result the information will be stored by the processor in the correct location 209. Once either a read or write has occurred, the processor will go back to its wait loop, waiting for the processor to once again initiate communications.

Figure 9:
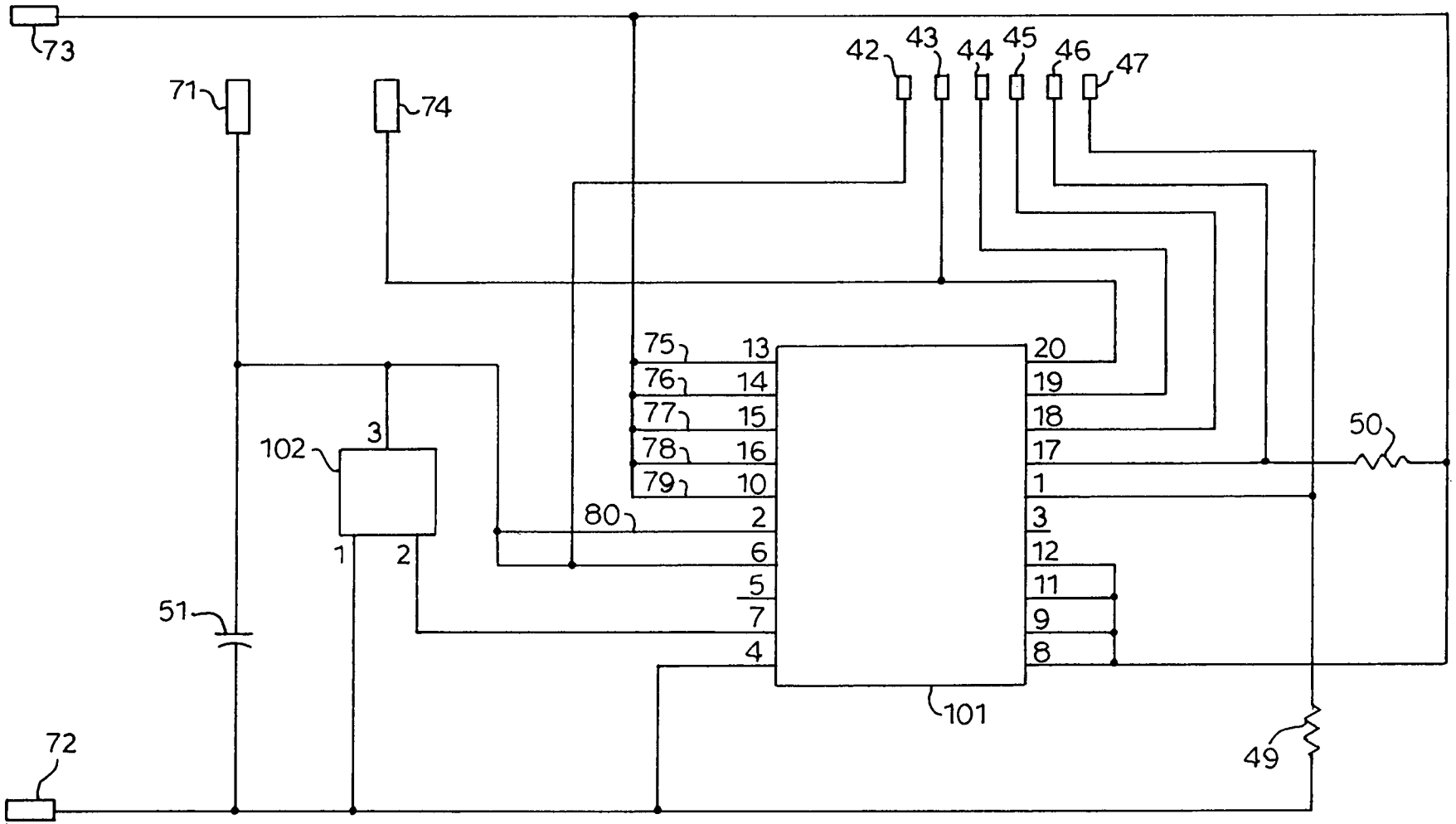
FIG. 9 is a schematic drawing of a replacement electronic circuit.

An embodiment of the present invention that incorporates the ability to be reprogrammed serially is illustrated in FIG. 9. This schematic is similar to the one depicted in FIG. 4. The circuit in FIG. 9 has some major differences. Due to size constraints, the Shottky diode 53 has been eliminated and the internal diodes of the processor are utilized instead. Second, power is sent through several input pins of the processor 75, 76, 77, 78, and 79. This process will charge the capacitor 51 and activate the reset circuit 102 through the passive VCC pin 80. The programming voltage necessary to reprogram the part will be provided on the voltage contact 71. The new program data will be sent down the serial programming contact 74. The data contact 73 and the ground contact 72 are in the same orientation as the second electronic circuit printer interfacing ground contact 38 and second electronic circuit printer interfacing data contact 39 of the secondary circuit design. This new design as shown in FIG. 9 is used as a complete replacement to the nonfunctional circuit. The design assumes that the processor is able to return the appropriate hash value to the printer and that the use of the nonfunctional circuit is unnecessary.

As described above, the resistor 50 may be utilized for additional maintenance functionality. Specifically, this maintenance functionality allows the processor to drive the data line to a logic high and monitor the line to make sure that electrically the port is acting appropriately. If the port is not operating correctly, the microprocessor can then utilize another port to send and receive data. For example, the microprocessor 101 may include a first input and output (I/O) port 12 connected to the external data contact 73. A second I/O port 11 is connected to the external data contact 73. As can be seen in FIG. 9, multiple I/O ports are connected to the external data contact 73. The microprocessor controls the electronic circuit and responds to read memory commands and write memory commands received through the external contact on the I/O ports. A third port 17 of the microprocessor 101 is also connected to the external data contact 73 and is adapted to source current. The microprocessor 101 is initially configured to send and receive data through the first I/O port 12. The microprocessor 101 tests the functionality of the first I/O port 12 by directing the third port 17 to source current and drive the external data contact 73 to a predetermined voltage, and then reads a voltage received by the first I/O port 12 in response to sourced current. If the microprocessor 101 determines the first I/O port 12 is not functioning correctly based on the read voltage, the microprocessor 101 will send and receive data through the second I/O port 11. Additionally, if the microprocessor 101 determines the first I/O port 12 is not functioning correctly, the microprocessor 101 will write a value to a memory of the electronic circuit indicating the first I/O port 12 is not functioning correctly. This value may be printed by the printer when a test page is printed. As described above, the memory stores a value indicating an amount of consumable matter remaining in the printer consumable unit. In one aspect, the third port 17 is connected to the external data contact 73 through the resistor 50. In another aspect, the microprocessor 101 tests the functionality of all of the I/O ports and selects a functioning I/O port to send and receive data.

Figure 10:
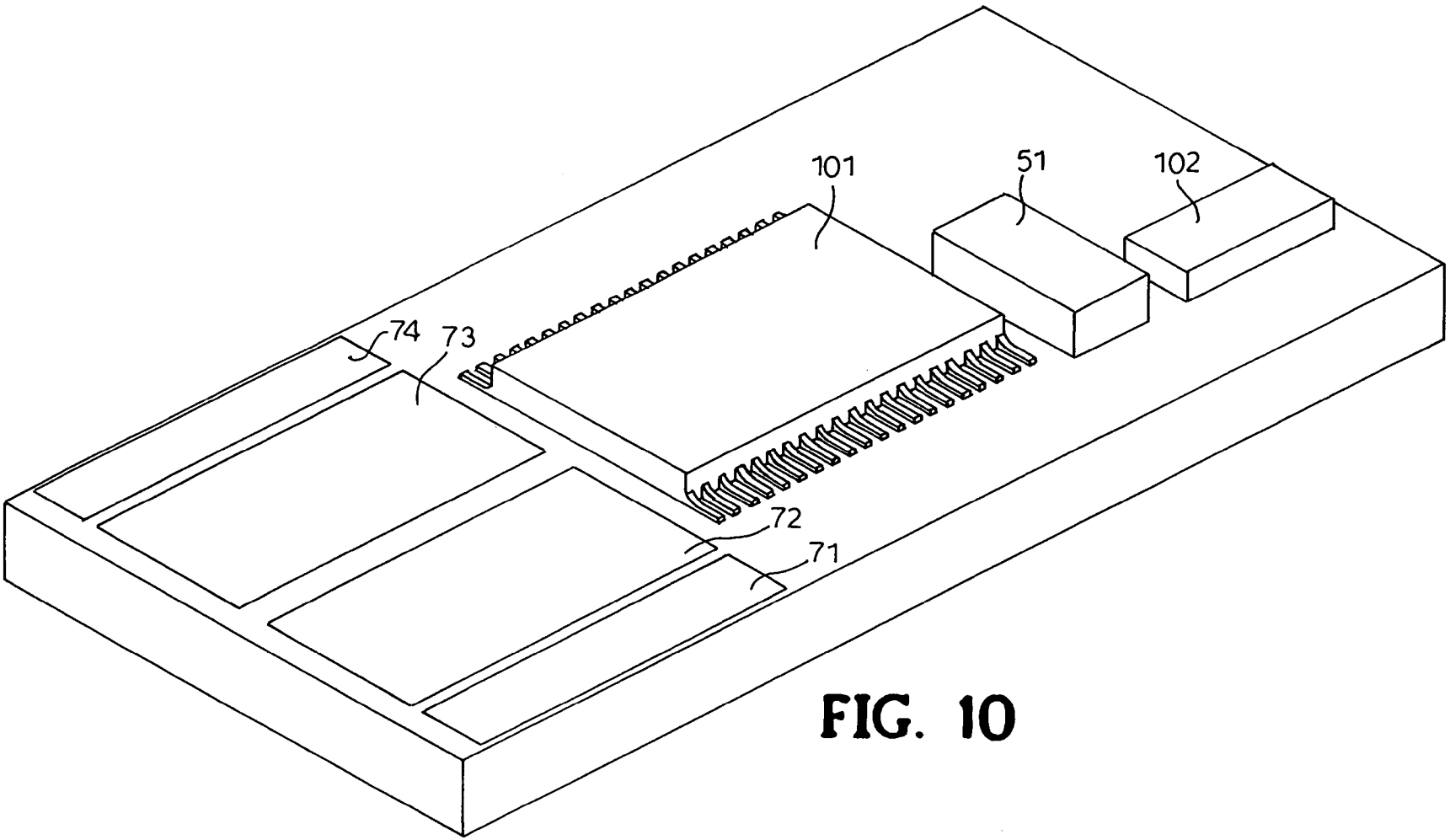
FIG. 10 is a perspective view of a replacement electronic circuit board.

FIG. 10 is an illustration of the physical board layout of the preferred embodiment. During the reprogramming mode, the replaceable consumable unit is removed from the printer and a programming dongle is applied to the device and the microprocessor may be reprogrammed.

Printers in general have the ability to determine how much toner remains in the current replaceable consumable unit installed in the printer. One method described in U.S. Pat. No. 5,995,772, issued to Barry, et al., describes how a paddle would measure a delay as it rotated through toner contained in a toner hopper. The amount of delay experienced by the paddle is proportional to the amount of toner remaining in the cartridge. This delay is then used in a mathematical equation to determine how much toner is remaining in the toner hopper. Another way of determining toner level is a variation of the paddle. This variation would determine how long and how far the paddle is able to freely rotate from the top of its arch to the point it contacted toner within the toner hopper. Instead of a delay, as the paddle made its way through the toner, there would be a brief period of time that the drive shaft would not be moving the paddle since it is rotating freely as it falls. Another alternative means to determine how much toner remains is to measure the electrical or magnetic characteristics of the toner remaining in the hopper. The printer would measure the impedance or capacitance across the toner and then determine the appropriate amount of toner remaining accordingly.

Once a printer has determined how much toner is remaining it has to convey this information to the end user as well as keep a running log for its own purposes. One particular way a printer stores how much toner is remaining is the use of a "bucket level." The printer stores a value associated with the amount of toner remaining in the bucket level memory location of the electronic circuit on the replaceable consumable unit. This area of memory is capable of being written to on a very limited basis. Initially, this bucket level will be "full" on a new or newly refurbished replaceable consumable unit. As toner is consumed the bucket level will be adjusted accordingly. The bucket level can only be decremented and never incremented during the operation of the replaceable consumable unit. If the bucket levels were ever to increase by a certain percentage, then the printer would detect this as an unauthorized attempt to refill the replaceable consumable unit and it will disable the particular replaceable consumable unit. Printer manufacturers have determined that most replaceable consumable units, once installed into a printer, may not be refilled during its current life cycle. Once the amount of usable toner has been determined to be "empty" by the printer, the printer will then store an "empty" bucket level value in the electronic circuit. Thereafter the printer will disable the replaceable consumable unit from operating by writing to another location in the circuit memory that is analogous to an "on/off" switch. In order for the printer to operate the location must correspond to an "on" value. Once this location has been rewritten with an "off" value the replaceable consumable unit will no longer function. The cartridge will then either be recycled or thrown away. The process of making these locations in memory unalterable is analogous to recording information on a 3½" floppy diskette, that has a write protection tab. Once the memory protection tab has been changed, the floppy becomes write protected.

In order to better understand the additional functionality that a replacement circuit may be able to offer, it is important to understand the significant parts of the replaceable consumable unit. Some of these parts in particular may be controlled by the actions of the replacement circuit.

The operation of a typical xerographic replaceable consumable unit is described in the prior art U.S. Pat. No. 5,012,289 issued to Aldrich, et al. In this patent, the process by which toner is transferred from the toner hopper to the developer roller and then to the OPC is outlined in great detail. FIG. 11 is an illustration of a prior art toner hopper assembly of a cartridge that utilizes this type of process. This is the same toner hopper assembly shown in FIG. 1 and FIG. 2. Once the toner hopper assembly 3 is separated from the waste bin assembly 4 the individual components may be identified, cleaned, replaced or refilled.

In FIG. 11, toner is added into the toner fill hole 17 either when the cartridge is new or being refurbished. The toner hopper cap 8 fits over this hole. This toner hopper cap 8 may contain material such as tyvek® that will allow air to flow in and out of the toner hopper reservoir 20. The tyvek® will have large enough pores to allow the air to flow but will restrict any toner particles from escaping. This is essential because any pressure differential between the air inside the toner hopper reservoir 20 and the surrounding air may result in toner leakage from any number of critical places. The material may be affixed to the toner hopper cap with glue or pressure. Another alternative is to use a heat seal to hold the tyvek(l in place.

The developer roller 24 sits on an axle and is rotated by a developer roller drive gear 12. At the opposite end of the axle, the developer roller contact bushing 11 engages the developer electrical contact 10, which allows for a DC potential to be applied across the developer roller 24 providing a charge necessary to negatively charge the toner. Sufficient voltage is required to differentially bias the toner and allow it to become electrically charged. As a result the toner will be attracted to the appropriate locations on the OPC drum (not shown), which will contain the image to be transferred to the print media. The OPC drum will be in close proximity to the developer roller 24 when the cartridge 1 is fully assembled. This proximity allows the toner to migrate from the developer roller to the OPC drum. Once toner has been transferred to the OPC drum, print media will be fed into the printer and the toner will become affixed to the media during the fusing process.

Behind the developer roller is an adder roller 15. The adder roller 15 is in physical contact with the developer roller 24 and is instrumental in ensuring a good supply of toner is presented to the developer roller. The adder roller 15 also has an adder roller electrical contact 16 that allows a potential supplied by the printer to pass through the adder roller 15. The adder roller 15 provides an initial negative charge to the toner supply. Additionally, the adder roller 15 is pressed against the developer roller 24 and the friction that results contributes additional negative charge to the toner passing between the developer roller 24 and the adder roller 15. The toner will be electrically charged in a two-stage process. The adder roller 15 provides the initial charge, and the developer roller 24 provides the subsequent charge.

In this particular replaceable consumable unit there is no primary charge roller (PCR). Instead the PCR is resident inside the printer. The main purpose of the PCR is to reapply an even electrical charge to the OPC drum so it will wipe clean any latent images left on the drum. As the OPC rotates, a laser will etch an image on the drum creating areas of less negatively charged surfaces that correspond to the lines or shapes of the image. As the OPC rotates and comes in contact with the developer roller 24, toner will be attracted to the less negatively charged areas on the surface of the OPC. Once the toner has become affixed to the OPC, paper or other media is introduced into the printing process. The area behind the printer will also be electrically charged to the toner then migrated to the media and is melted into place.

During the printing process the voltages applied by the printer to the electrical elements of the cartridge may vary. When a higher voltage is applied to certain components, the resulting electric charge will be greater and more toner will be attracted to the components. As a result the print image will be darker. Over the lifetime of the cartridge, the voltages have a tendency to fluctuate and in some cases increase substantially. This may be due to the printer manufacturers intent to ensure that there is enough toner for the components to make good quality prints. It also may be a way to use toner faster thus hastening the replaceable consumable unit's toner consumption and effectively shortening the life of the cartridge.

Some printers have the ability to change the voltages being applied to these electrical components. Prior art describes changing the voltages on these components in relation to analyzing the images as they are processed off the OPC drum, which is usually done as part of a calibration procedure. Instead of basing the voltage potential on the image, a new replacement circuit would base the voltage on a specific toner level condition. This would occur when the toner in the toner hopper has reached a "toner low" state and conservation of toner is important. By returning the voltages back to their original operating states or to any level that would make the printer use less toner, the print quality would remain the same while reducing background printing. This in turn would conserve the amount of toner being used and prolong the life of the replaceable consumable unit. In the preferred embodiment of the present invention, the voltage of the PCR would be maximized (highest negative voltage) at the same time the voltage of the developer roller would be minimized (least negative voltage). The appropriate values corresponding to this change would be loaded into the replacement electronic circuit once a specific toner value had been achieved. Then the next time the printer is opened or the power is cycled, this new value will be read and the changes will then be implemented. An alternative embodiment of the present invention would change the voltage of the PCR to become minimized and the voltage to the developer roller to become maximized. The voltages may be changed in numerous combinations, depending on the specific printer and the desired results.

Although this invention has been described with respect to the specific embodiments herein, it should be understood that the invention is not limited to these embodiments, they may take other shapes and forms to accommodate the particular requirements at issue. Other variations and departures from the specific embodiment disclosed herein may also be used without departing from the spirit of this invention.

What is claimed is:

1. A method of remanufacturing a replaceable consumable unit comprising:

providing the replaceable consumable unit comprising a first electronic circuit, said first electronic circuit at least partially inoperable;

providing a second electronic circuit;

communicatively connecting the second electronic circuit to the first electronic circuit; and intercepting, by the second electronic circuit, signals sent by an imaging system to the first electronic circuit.

2. The method of claim 1 further comprising;

transmitting, by the second electronic circuit, a portion of the intercepted signals to the first electronic circuit.

3. The method of claim 2 wherein the intercepted signals transmitted to the first electronic circuit comprise at least a portion of an authentication sequence.

4. The method of claim 3 further comprising:

processing, by the second electronic circuit, intercepted signals not transmitted to the first electronic circuit.

5. The method of claim 4 wherein the intercepted signals processed by the second electronic circuit comprise commands to write memory storing a value corresponding to an amount of toner remaining in the replaceable consumable unit.

6. The method of claim 4 wherein the intercepted signals processed by the second electronic circuit comprise commands to read memory storing a value corresponding to an amount of toner remaining in the replaceable consumable unit.

7. The method of claim 1 wherein the first electronic circuit comprises a memory address which cannot be overwritten.

8. The method of claim 7 wherein the value stored at the memory address indicates that no useable toner remains in the replaceable consumable unit.

9. The method of claim 8 wherein the intercepted signals comprise a command to read the memory address.

10. The method of claim 8 wherein the intercepted signals comprise a command to write the memory address.

11. The method of claim 2 further comprising:

intercepting, by the second electronic circuit, signals sent by the first electronic circuit to the imaging system.

12. The method of claim 11 further comprising:

transmitting, by the second electronic circuit, to the imaging system at least a portion of the signals intercepted from the first electronic circuit.

13. The method of claim 12 wherein the signals transmitted to the imaging system comprise at least a portion of an authentication sequence.

14. A remanufactured replaceable consumable unit comprising:

a first electronic circuit, said first electronic circuit at least partially inoperable; and a second electronic circuit communicatively connected to the first electronic circuit, said second electronic circuit intercepting signals sent by an imaging system to the first electronic circuit.

15. The remanufactured replaceable consumable unit of claim 14 wherein the second electronic circuit transmits a portion of the intercepted signals to the first electronic circuit.

16. The remanufactured replaceable consumable unit of claim 15 wherein the intercepted signals transmitted to the first electronic circuit comprise at least a portion of an authentication sequence.

17. The remanufactured replaceable consumable unit of claim 16 wherein the second electronic circuit processes intercepted signals not transmitted to the first electronic circuit.

18. The remanufactured replaceable consumable unit of claim 17 wherein the intercepted signals processed by the second electronic circuit comprise commands to write memory storing a value corresponding to an amount of toner remaining in the replaceable consumable unit.

19. The remanufactured replaceable consumable unit of claim 17 wherein the intercepted signals processed by the second electronic circuit comprise commands to read memory storing a value corresponding to the amount of toner remaining in the replaceable consumable unit.

20. The remanufactured replaceable consumable unit of claim 14 wherein the first electronic circuit comprises a memory address which cannot be overwritten.

21. The remanufactured replaceable consumable unit of claim 20 wherein a value stored at the memory address indicates that no useable toner remains in the replaceable consumable unit.

22. The remanufactured replaceable consumable unit of claim 21 wherein the intercepted signals comprise a command to read the memory address.

23. The remanufactured replaceable consumable unit of claim 21 wherein the intercepted signals comprise a command to write the memory address.

24. The remanufactured replaceable consumable unit of claim 15 wherein the second electronic circuit intercepts signals sent by the first electronic circuit to the imaging system.

25. The remanufactured replaceable consumable unit of claim 24 wherein the second electronic circuit transmits to the imaging system at least a portion of the signals intercepted from the first electronic circuit.

26. The method of claim 25 wherein the signals transmitted to the imaging system comprise at least a portion of an authentication sequence.

* * * * *